US007813660B2

(12) United States Patent
Takahashi et al.

(10) Patent No.: US 7,813,660 B2
(45) Date of Patent: Oct. 12, 2010

(54) IMAGE ADJUSTING METHOD AND IMAGE FORMING APPARATUS

(75) Inventors: Katsumi Takahashi, Toride (JP); Yuichiro Maeda, Kashiwa (JP); Yushi Oka, Abiko (JP); Kenji Kuroki, Toride (JP); Yuzo Matsumoto, Abiko (JP); Kazunori Togashi, Toride (JP); Takuya Kawamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 11/859,075

(22) Filed: Sep. 21, 2007

(65) Prior Publication Data

US 2008/0075486 A1 Mar. 27, 2008

(30) Foreign Application Priority Data

Sep. 25, 2006 (JP) ..... 2006-259493
Sep. 3, 2007 (JP) ..... 2007-228287

(51) Int. Cl.
*G03G 15/00* (2006.01)

(52) U.S. Cl. ..... 399/43

(58) Field of Classification Search ..... 399/43, 399/33, 372

See application file for complete search history.

(56) References Cited

U.S. PATENT DOCUMENTS 6,937,826 B2 8/2005 Yamamoto et al.
7,013,093 B2 * 3/2006 Nakazato ..... 399/27
7,237,772 B2 7/2007 Kamamura ..... 271/9.01
7,249,759 B2 7/2007 Komatsu et al. ..... 271/97
2002/0118976 A1 * 8/2002 Fischer ..... 399/49
2003/0210412 A1 * 11/2003 Ishibashi ..... 358/1.9
2004/0136025 A1 * 7/2004 Moriyama et al. ..... 358/1.14
2004/0190924 A1 * 9/2004 Iwasaki et al. ..... 399/68
2004/0217538 A1 11/2004 Kawamura ..... 271/9.01
2005/0082737 A1 4/2005 Sasaki et al. ..... 271/9.12
2005/0220478 A1 * 10/2005 Ai et al. ..... 399/101
2006/0061032 A1 3/2006 Kamiya et al. ..... 271/221
2007/0228029 A1 10/2007 Komatsu et al. ..... 219/216

* cited by examiner

*Primary Examiner*—David M Gray
*Assistant Examiner*—Rodney Bonnette
(74) *Attorney, Agent, or Firm*—Fitzpatrick, Cella, Harper & Scinto

(57) ABSTRACT

An image forming apparatus forms a toner image onto sheets at the first feeding interval on a photoconductor or intermediate transfer member and, if the temperature of a fixing unit falls outside a set temperature range, the sheet layout is changed to a feeding interval wider than the first feeding interval. Adjustment processing is performed based on the image forming condition so that the feeding interval is changed to a wider one in the feeding interval changing step during image formation and it is determined in the determination step to perform adjustment processing, toner patch images are formed in an area where no toner image is formed on the photoconductor or intermediate transfer member . The adjustment processing is performed based on reading toner patch images.

11 Claims, 13 Drawing Sheets

FIG. 6

| 301 IMAGE ADJUSTMENT TYPE | 302 COUNTER THRESHOLD (N) | 303 COUNTER THRESHOLD MARGIN (M) | 304 IMAGE ADJUSTING TIME |
|---|---|---|---|
| 305 IMAGE DENSITY ADJUSTMENT | 300 SHEETS | 30 SHEETS | 30 SEC |
| 306 COLOR MISREGISTRATION ADJUSTMENT | 400 SHEETS | 40 SHEETS | 50 SEC |
| ... | ... | ... | ... |

IMAGE ADJUSTING METHOD AND IMAGE FORMING APPARATUS

BACKGROUND OF THE INVENTION

1. Field of the Invention

The present invention relates to an image adjusting method for an output image in an image forming apparatus, and the image forming apparatus.

2. Description of the Related Art

In general, image forming apparatuses such as a color copying machine and color printer need to always output stable images.

In practice, however, the density of each color varies and color misregistration occurs owing to changes in ambient temperature and moisture, deterioration of the image forming system over time, and the like.

To prevent this, there is known an image forming apparatus which adjusts the process conditions of each image forming station by forming a pattern image for detecting the image density and by optically detecting the density of the pattern image. This adjustment is called density adjustment processing. There is also known an image forming apparatus which adjusts a reflecting mirror inserted in the optical laser path and adjusts the image write timing by forming a pattern image for adjusting the image forming position and by optically detecting the position of the pattern image. This adjustment is called position adjustment processing. Conventionally, whether to perform these adjusting processes is determined depending on count data such as the number of prints or the total number (video count) of data "1" among image data. This technique can always output stable images (e.g., see U.S. Pat. No. 6,937,826).

However, an image forming sequence, which is fundamental in image forming processing, must be interrupted when executing the above-described processing of forming an adjustment pattern, optically detecting the pattern image, and feeding back the detection result in order to adjust various image forming conditions. Because image forming processing is interrupted during the adjustment, the user productivity decreases; that is, the image forming requires a long time.

Recently, as the speeds of a color copying machine, color printer, and the like increases, a decrease in productivity by a down sequence becomes an issue in addition to the decrease in productivity by image adjustment.

The down sequence is to print by widening the sheet feeding interval in order to prevent the temperature of a fixing unit from becoming lower than a temperature at which the fixing characteristic can be maintained. Such temperature drop occurs when, for example, a sheet deprives heat of the fixing unit during continuous printing. As the printer becomes faster, the amount of heat deprived by sheets of the fixing unit becomes larger than that of heat applied from the heater to the fixing unit. The temperature of the portion of the fixing unit where paper passes readily drops, and the printer is prone to shift to the down sequence.

Another example of the down sequence is to print by widening the sheet feeding interval in order to prevent a temperature in an area of the fixing unit where no sheet passes, from exceeding a specific temperature necessary to ensure the quality of the surface of the fixing roller. Such temperature rise occurs during continuous printing on sheets at a size smaller than the width of the fixing unit. When the amount of heat applied from the heater increases along with speed-up of printers, the temperature difference between the portions where paper passes and paper does not pass becomes large during printing on small-size sheets. The temperature at the portion where paper does not pass readily rises, so the printer is prone to shift to the down sequence.

As described above, the user suffers two productivity decrease factors, i.e., the conventional image adjustment and the down sequence.

SUMMARY OF THE INVENTION

The present invention has been made to overcome the conventional drawbacks, and has as its object to provide an image adjusting method of ensuring both good fixing characteristic and image quality without decreasing productivity as much as possible despite two productivity decrease factors, i.e., image adjustment and the down sequence, and an image forming apparatus therefore.

To achieve the above objects, according to an aspect of the present invention, there is provided an image forming apparatus comprising:

a feeding unit adapted to feed a sheet;

an image forming unit adapted to form an image on an image carrier;

a transfer unit adapted to transfer, to the sheet, the image formed on the image carrier;

a fixing unit adapted to fix the transferred image onto the sheet;

a temperature detection unit adapted to detect a temperature of the fixing unit;

a feeding interval changing portion adapted to widen a feeding interval between sheets fed by the feeding unit, when the temperature detection unit detects that the temperature of the fixing unit falls outside a set temperature range;

an adjustment portion adapted to execute adjustment processing to form on the image carrier an adjusting image for adjusting an image forming condition, and adjust the image forming condition on the basis of a result of reading the adjusting image; and a determination portion adapted to determine a timing to execute the adjustment processing, wherein when the feeding interval changing portion widens the feeding interval, the determination portion changes reference value used for determining the timing to execute the adjustment processing.

According to another aspect of the present invention, there is provided an image adjusting method for an image forming apparatus having a feeding unit adapted to feed a sheet, an image forming unit adapted to form an image on an image carrier, a transfer unit adapted to transfer, to a sheet, the image formed on the image carrier, a fixing unit adapted to fix the transferred image onto the sheet, and a temperature detection unit adapted to detect a temperature of the fixing unit, the method comprising:

a feeding interval changing step of widening feeding interval between sheets fed by the feeding unit, when the temperature detection unit detects that the temperature of the fixing unit falls outside a set temperature range;

an adjustment step of executing adjustment processing to form on the image carrier an adjusting image for adjusting an image forming condition, and adjust the image forming condition on the basis of a result of reading the adjusting image; and a determination step of determining a timing to execute the adjustment processing, wherein when a feeding interval is widened in the feeding interval changing step, a reference value is changed in the determination step, which is used for determining the timing to execute the adjustment processing.

Further features of the present invention will become apparent from the following description of exemplary embodiments with reference to the attached drawings.

BRIEF DESCRIPTION OF THE DRAWINGS

FIG. 6 is a table showing an example of the adjustment type, a parameter for determining a condition to perform adjustment processing, and the image adjustment processing time;

DESCRIPTION OF THE EMBODIMENT

A preferred exemplary embodiment of the present invention will be described in detail below with reference to the accompanying drawings. The sizes, materials, shapes, and relative arrangement of building components set forth in this embodiment do not limit the scope of the present invention unless it is specifically stated otherwise. In the following description, a transfer material means printing media such as paper, an OHP sheet, and cloth in various shapes.

Figure 1A:
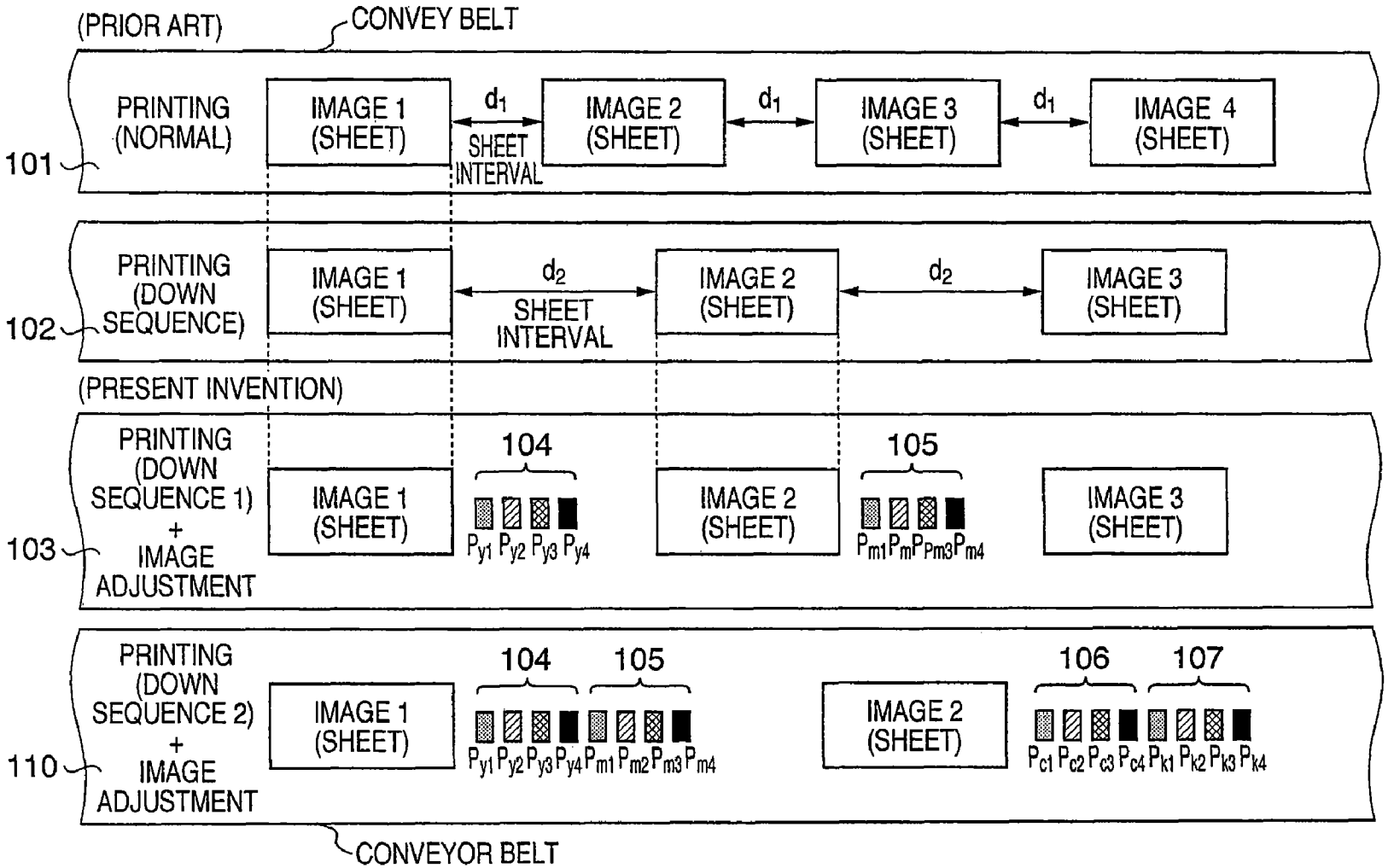
FIG. 1A is a view for explaining the features of adjustment processing in an image forming apparatus according to the present invention.

<Features of Invention: FIG. 1A>

The features of an image forming apparatus according to the present invention will be described first with reference to FIG. 1A.

Normal printing, down sequence printing, and adjustment processing by a conventional image forming apparatus will be explained. Reference numeral 101 denoted normal printing. Images 1-4 in normal printing 101 is formed on a sheet by normal printing 101. In normal printing 101, a toner image is transferred to a sheet from a photoconductor or intermediate transfer member while the feeding interval between sheets is controlled to be close to the first interval $d_1$. A fixing unit fixes the transferred toner image to form an image. If a temperature sensor detects during the normal printing 101 that the temperature of the fixing unit falls outside a set temperature range, a down sequence printing 102 is executed to widen the interval between sheets to close to the second interval $d_2$. This can suppress degradation of the image quality even when the temperature of the fixing unit falls outside the set temperature range.

At the timing when density adjustment processing is performed during continuous printing, printing is interrupted to execute density adjustment processing. In density adjustment processing, a variety of pattern images (toner patch images) for measuring the density are formed to read their image densities. Based on the read image densities, the image density is adjusted (not shown).

Reference numeral 103 denotes an example of down sequence printing executed by the image forming apparatus according to the present invention, at the timing when density adjustment processing is performed during down sequence printing. In the down sequence printing 103, a toner patch image 104 made up of toner patch images $P_{y1}$, $P_{y2}$, $P_{y3}$, and $P_{y4}$ can be formed in an area (the area between images 1 and 2) which is wider than that in normal printing 101 and does not bear any toner image on the conveyor belt. The conveyor belt may be replaced with an intermediate transfer belt as described in U.S. Pat. No. 6,937,826. Also, a toner patch image 105 made up of toner patch images $P_{m1}$, $P_{m2}$, $P_{m3}$, and $P_{m4}$ can be formed in the area between images 2 and 3. The density sensor reads the densities of the formed toner patch images, and density adjustment processing can be executed. This can shorten the printing time as compared with the conventional case where printing is interrupted in order to perform density adjustment processing during down sequence printing.

As another example during down sequence printing, down sequence printing 110 represents an example of density adjustment processing when the interval between sheets is larger than the interval $d_2$ between sheets in the down sequence printing 103. In the down sequence printing 110, the toner patch image 104 made up of the toner patch images $P_{y1}$, $P_{y2}$, Py3, and $P_{y4}$, and the toner patch image 105 made up of the toner patch images $P_{m1}$, $P_{m2}$, $P_{m3}$, and $P_{m4}$ can be formed in an area (area between images 1 and 2) where no toner image is formed on the conveyor belt. In addition, a toner patch image 106 made up of toner patch images $P_{c1}$, $P_{c2}$, $P_{c3}$, and $P_{c4}$, and a toner patch image 107 made up of toner patch images $P_{k1}$, $P_{k2}$, $P_{k3}$, and $P_{k4}$ can be formed in the area between image 2 and image 3 (not shown). The density sensor reads the densities of the formed toner patch images, and density adjustment processing can be executed. This can shorten the printing time as compared with the conventional case where printing temporarily stops in order to perform density adjustment processing during down sequence printing.

Figure 1B:
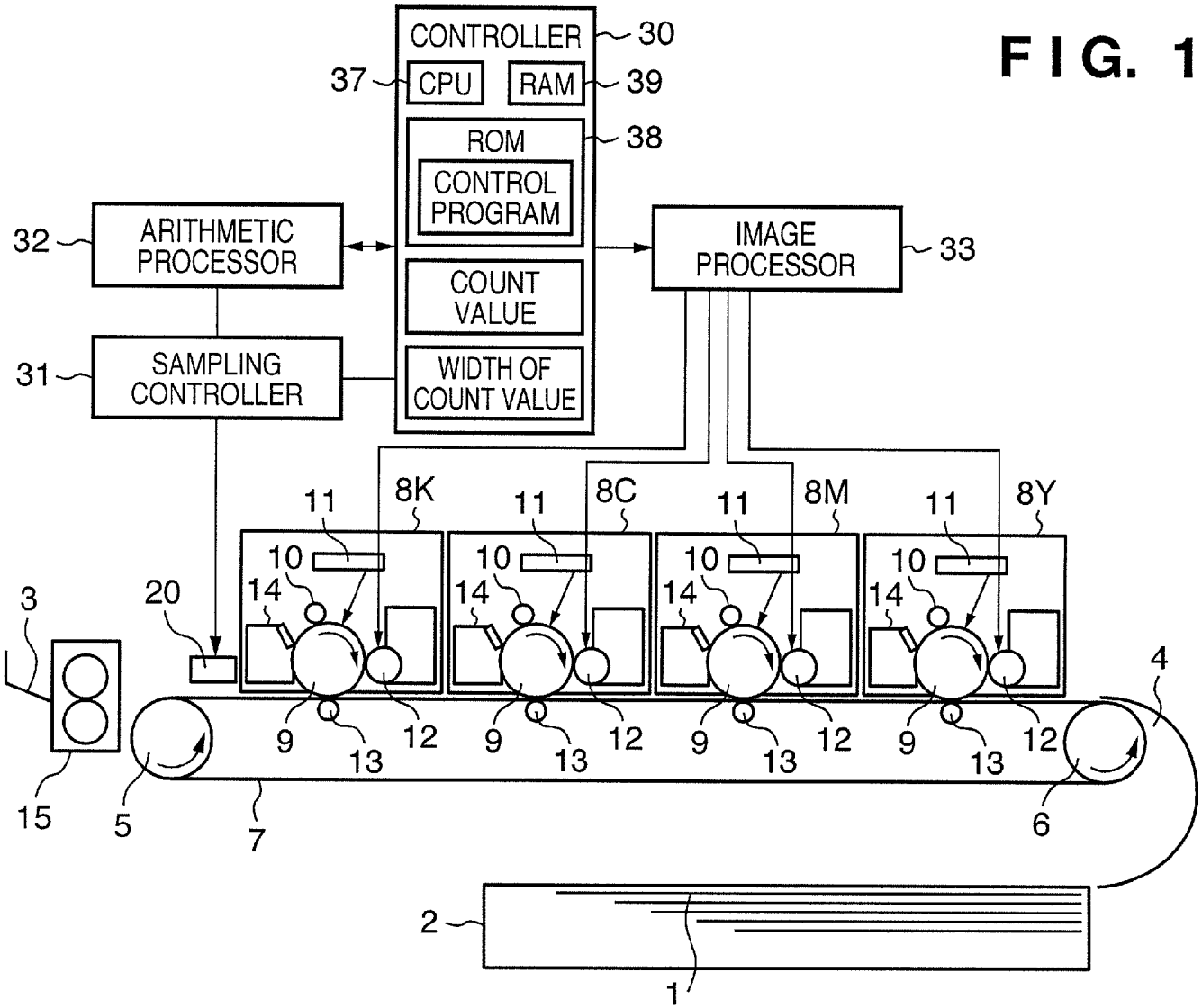
FIG. 1B is a schematic view showing an example of the image forming apparatus according to the present invention.

<Structure Example of Image Forming Apparatus: FIG. 1B>

FIG. 1B schematically shows a color image forming apparatus serving as an example of the image forming apparatus according to the present invention.

As shown in FIG. 1B, the image forming apparatus has a feeding path 4 extending to a delivery unit 3 from a paper feed unit 2 which stores sheets 1. The feeding path 4 includes a conveyor belt 7 serving as an endless carrier looped between a belt driving roller 5 and a freely rotatable belt driven roller 6. The belt driving roller 5 rotates upon receiving a driving force from a driving source (not shown). Four image forming stations (image forming units) 8Y, 8M, 8C, and 8K for yellow, magenta, cyan, and black are arranged above the conveyor belt 7 in the order mentioned. Each image forming station forms an image by an electrophotographic process.

Each image forming station has a photoconductor 9 serving as a latent image carrier which contacts the conveyor belt 7. The photoconductor 9 is surrounded with a charger 10, an exposing unit 11, a developing unit 12, a transfer roller 13 serving as a transfer unit, and a photoconductor cleaner 14. A fixing unit 15 is arranged at a location spaced apart from the conveyor belt 7.

In the image forming apparatus, the conveyor belt 7 conveys the sheet 1 fed from the paper feed unit 2. During conveyance, the image forming station for each color forms an image by an electrophotographic process including charging, exposure, development, and transfer.

By this process, a full-color toner image is transferred onto the sheet 1, heated and pressed by the fixing unit 15, and thereby firmly fixed onto the sheet 1.

(Image Density Detecting Method)

An image density detecting method will be explained.

As shown in FIG. 1B, a density sensor 20 serving as an image density detector is arranged near the conveyor belt 7 on the downstream side of the image forming station 8K for black serving as a final developing color. To perform density adjustment processing and position adjustment processing, the image forming apparatus comprises a controller 30, sampling controller 31, arithmetic processor 32, and image processor 33. The controller 30 has a CPU 37 which executes density adjustment processing and position adjustment processing by controlling respective units using a RAM 39 as a work area on the basis of a control program stored in a ROM 38. Details of these units will be described with reference to FIG. 4.

As described above, the electrophotographic color image forming apparatus cannot obtain a proper color tone of an original color image if the image density varies depending on conditions such as the use environment and the number of prints. To obtain an image having a proper tone, toner patch images are tentatively formed in respective colors, and the density sensor 20 detects their densities. The detection result is fed back to adjust the developing bias and control the image density.

Figure 2:
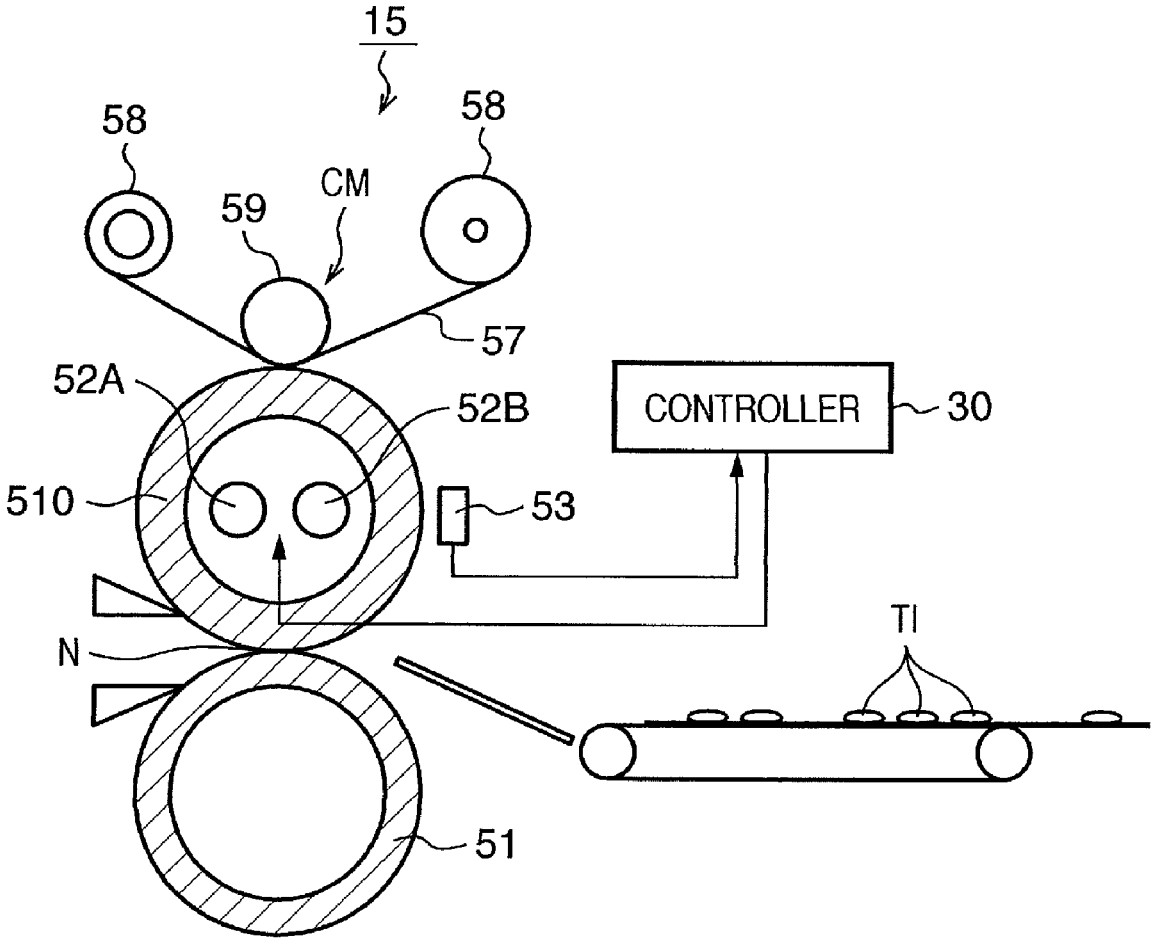
FIG. 2 is a schematic sectional view showing the schematic structure of a fixing unit.

(Structure Example of Fixing Unit: FIG. 2)

The fixing unit 15 will be described with reference to FIG. 2 which is a schematic sectional view showing the schematic structure of the fixing unit 15.

The fixing unit 15 is arranged downstream of the conveyor belt 7 in the sheet feeding direction. As shown in FIG. 2, a fixing roller 510 and pressurizing roller 51 serving as fixing members are in press contact with each other by a pressurizing mechanism (not shown). More specifically, the fixing roller 510 rotates in contact with a sheet surface bearing an unfixed toner image T1. The pressurizing roller 51 rotates in contact with a sheet surface opposite to the toner image bearing surface. A sheet passes through a nip N between the fixing roller 510 and pressurizing roller 51 in press contact with each other.

The fixing roller 510 incorporates two halogen heaters (to be referred to as a main heater 52A and sub-heater 52B hereinafter) serving as heating elements substantially juxtaposed to each other.

The pressurizing mechanism arranged outside the fixing unit 15 pressurizes the pressurizing roller 51 to the fixing roller 510. The pressurizing roller 51 is driven to rotate upon receiving a driving force from a driving mechanism arranged outside the fixing unit 15.

While the fixing roller 510 is driven by rotation of the pressurizing roller 51, a sheet entering the nip N is clamped and conveyed by the fixing roller 510 and pressurizing roller 51 and passes through the nip N.

A cleaning mechanism CM for cleaning the outer surface of the fixing roller 510 after fixing is arranged near the fixing roller 510 on the downstream side of the nip N in the rotational direction of the roller.

The cleaning mechanism CM serving as a cleaning member comprises two take-up rollers 58 between which a web 57 serving as a silicone oil-impregnated non-woven fabric is stretched by winding the web 57 around them. The cleaning mechanism CM comprises a press roller 59 for pressing the web 57 against the outer surface of the fixing roller 510.

More specifically, the cleaning mechanism CM removes residuals from the outer surface after fixing by winding the web 57 around the two take-up rollers 58 while pressing it against the outer surface of the fixing roller 510 by the press roller 59.

A thermistor temperature detection element (to be simply referred to as a thermistor 53 hereinafter) serving as a temperature detection unit is arranged in contact with the outer surface of the fixing roller 510. An output (to be referred to as a temperature output hereinafter) from the thermistor 53 is fed back to the controller 30 serving as a selection switching unit.

In the embodiment, the thermistor 53 is arranged in contact with the outer surface of the fixing roller 510. It is also possible to arrange the thermistor 53 near the outer surface of the fixing roller 510 and detect the temperature of the outer surface of the fixing roller 510. The controller 30 selects and switches the ON/OFF state of the main heater 52A and sub-heater 52B in accordance with a temperature output from the thermistor 53 so as to maintain the outer surface of the fixing roller 510 at a target temperature (fixing temperature). In the embodiment, the controller 30 controls all the units of the image forming apparatus.

Figure 3A:
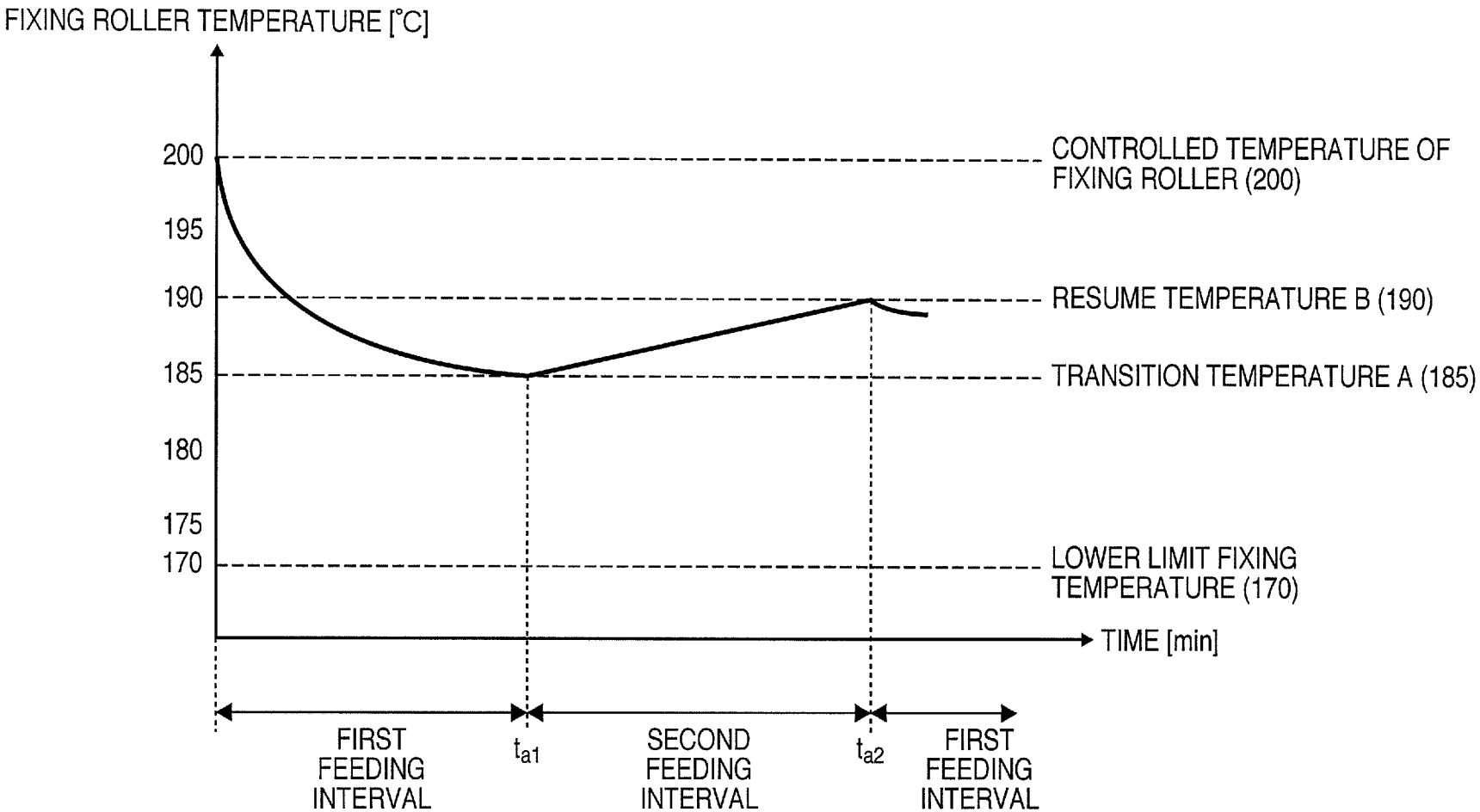
FIG. 3A is a graph for explaining an example of transition of the temperature of the fixing unit in a down sequence.
Figure 3B:
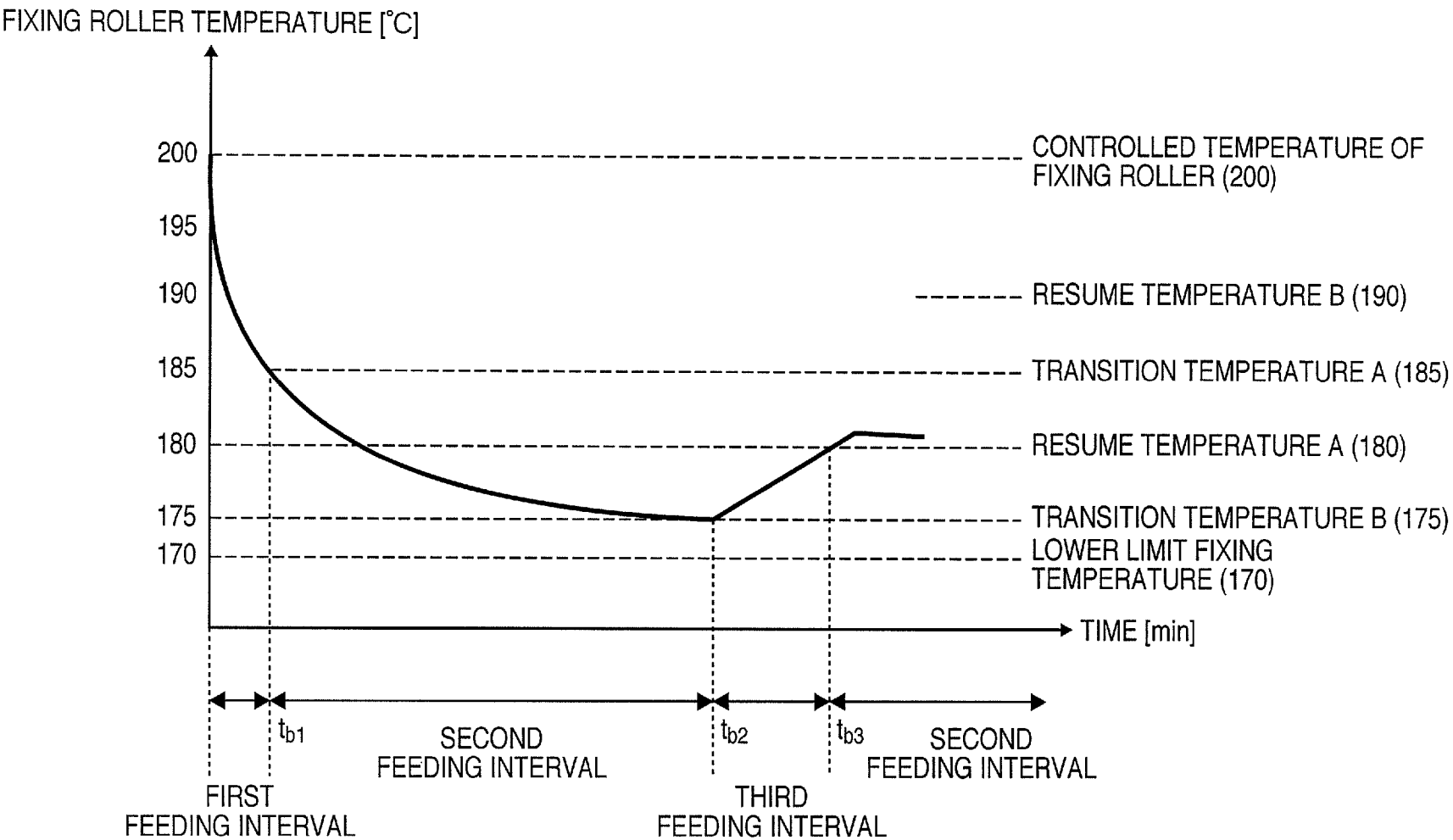
FIG. 3B is a graph for explaining another example of transition of the temperature of the fixing unit in the down sequence.
Figure 3C:
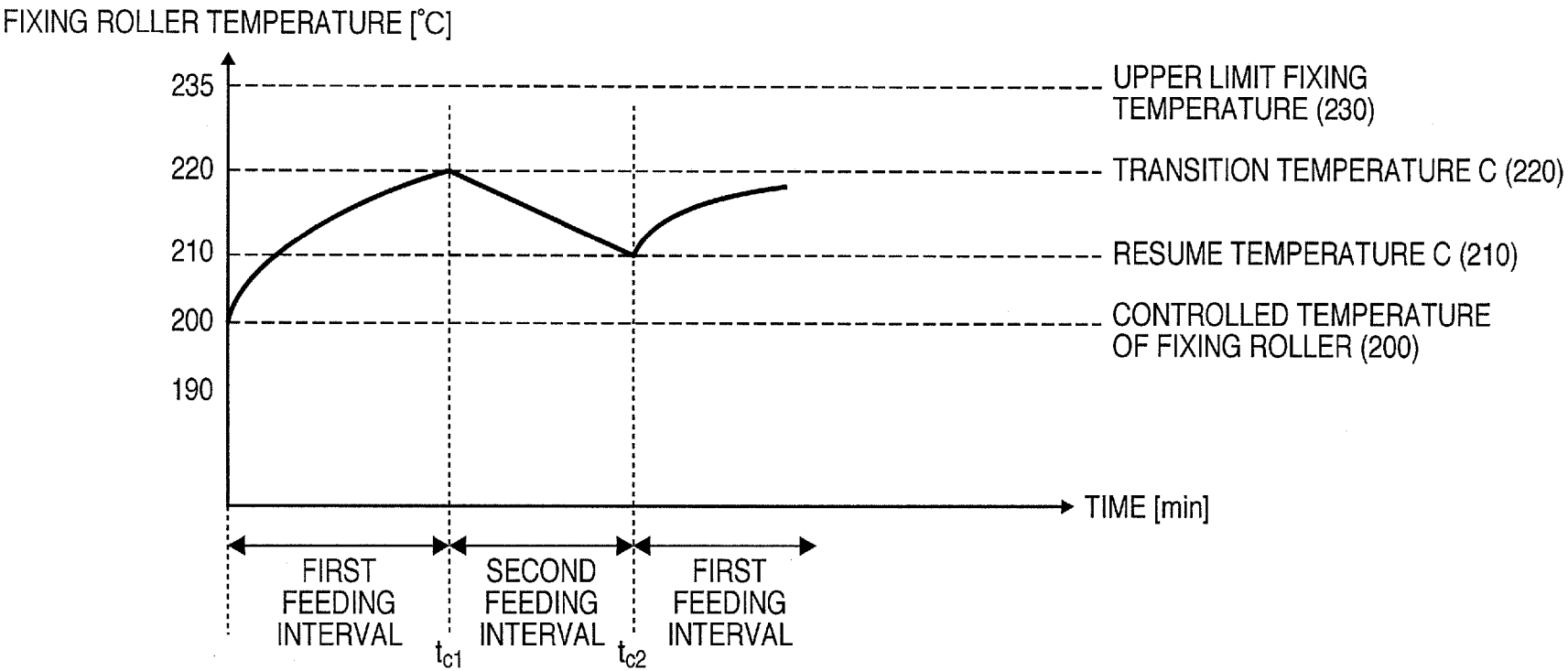
FIG. 3C is a graph for explaining still another example of transition of the temperature of the fixing unit in the down sequence.

(Printing Example in Down Sequence: FIGS. 3A to 3C)

A down sequence triggered by the temperature drop of the fixing unit 15 will be explained with reference to FIGS. 3A to 3C.

The down sequence has two purposes. One is to prevent the temperature of the portion of the fixing unit where paper passes from lowering during continuous printing below a lower limit temperature at which the fixing characteristic can be maintained. The other is to prevent the temperature of the portion of the fixing unit where paper does not pass from exceeding a specific temperature. In these two cases, the purposes are achieved by printing by widening the sheet feeding interval from a normal one.

FIGS. 3A and 3B show examples of a down sequence to prevent the temperature of the portion of the fixing unit where paper passes from lowering below a lower limit temperature at which the fixing characteristic can be maintained. FIG. 3C shows an example of a down sequence to prevent the temperature of the portion of the fixing unit where paper does not pass from exceeding a specific temperature.

The down sequence will be first explained with reference to FIG. 3A.

FIG. 3A is a graph showing transition of the temperature of the portion of the fixing roller where paper passes. During warm-up, a commercial power supply supplies power to the two heaters to turn them on. Then, the temperature of the fixing roller rises to a controlled temperature (200° C.).

When, however, the fixing roller successively fixes images onto sheets, the sheets repetitively absorb heat from the fixing roller. Even if the main heater fully heats the fixing roller, the temperature of the fixing roller drops greatly. If fixing continues in this state, the fixing roller temperature becomes lower than a lower limit fixing temperature (170° C.) though it depends on the environment and paper type. This results in a fixing failure.

To prevent the fixing roller temperature from becoming lower than the lower limit fixing temperature, when the fixing roller temperature drops to 185° C. (=transition temperature A) or lower, the interval between sheets is widened from the first feeding interval to the second one.

As a result, the number of printed sheets per unit time (cpm: count per minute) decreases. The amount of heat absorbed per unit time by sheets from the fixing roller reduces, suppressing any further temperature drop of the fixing roller, and maintaining a good fixing characteristic.

The operation to decrease the number of printed sheets per unit time and output sheets is called the down sequence. The number of printed sheets to be decreased, i.e., the feeding interval is properly changeable in accordance with the image forming apparatus.

If fixing continues in the down sequence, the amount of heat supplied per unit time from the heater exceeds that of heat absorbed per unit time by sheets, and the fixing roller temperature starts rising. When the fixing roller temperature resumes to 190° C. (=resume temperature B), the interval between sheets changes from the second feeding interval to the first one, restoring the number of printed sheets per unit time (cpm: count per minute).

Next, the down sequence will be explained with reference to FIG. 3B.

FIG. 3B is a graph showing another example of transition of the temperature of the portion of the fixing roller where paper passes. Depending on the paper type and apparatus use environment, even after the number of printed sheets per unit time decreases, i.e., the interval between sheets is widened from the first feeding interval to the second one, the downward gradient becomes slow but the fixing roller temperature may keep dropping to the lower limit temperature of 170° C., as shown in FIG. 3B.

In this case, when the fixing roller temperature drops to 175° C. (=transition temperature B) or lower, the interval between sheets is further widened from the second feeding interval to the third one. Then, the number of printed sheets per unit time further decreases, suppressing any further temperature drop of the fixing roller and ensuring a good fixing characteristic. When the fixing roller temperature starts rising and resumes to 180° C. (=resume temperature A), the number of printed sheets per unit time is increased by restoring the interval between sheets from the third feeding interval to the second one.

If the fixing temperature drops again to 175° C. (=transition temperature B) during printing at the second feeding interval, the interval between sheets is widened again to the third feeding interval, ensuring a good fixing characteristic. To the contrary, if the fixing temperature resumes to 190° C. (=resume temperature B), the interval between sheets is restored from the second feeding interval to the first one. As result, the number of printed sheets per unit time increases, restoring an original productivity.

The down sequence will be explained with reference to FIG. 3C.

FIG. 3C is a graph showing still another example of transition of the temperature of portion of the fixing roller where paper does not pass. During warm-up, the temperature of the portion of the fixing roller where paper does not pass is kept at almost the same temperature (200° C.) as that of the portion where paper passes. When images are successively fixed onto small-size sheets like a letter-size sheet, the sheets absorb the temperature at the center of the fixing roller but do not deprive heat at the ends of the fixing roller. Hence, the temperature at the end of the fixing roller rises gradually. If fixing continues in this state, the fixing roller temperature exceeds an upper limit temperature (230° C.) at which the quality of the fixing roller can be maintained. Consequently, a defective image may be formed by a deteriorated fixing roller or the fixing roller may be damaged.

Thus, the fixing roller temperature is prevented from exceeding the upper limit temperature. More specifically, if the fixing roller temperature rises to 220° C. (=transition temperature C) or higher, the interval between sheets is widened from the first feeding interval to the second one, decreasing the number of printed sheets per unit time (cpm (the number of sheets/min)). The amount of heat absorbed per unit time by sheets from the fixing roller is reduced, suppressing temperature rise at the end of the fixing roller.

If fixing continues in the down sequence and the temperature at the end of the fixing roller resumes to 210° C. (=resume temperature C), the interval between sheets is restored from the second feeding interval to the first one, restoring the number of printed sheets per unit time (cpm (the number of sheets/min)).

Example of Adjustment Processing According to This Embodiment

Adjustment processing executed by the above-described image forming apparatus will be explained.

(Type of Adjustment Processing: FIG. 6)

FIG. 6 shows the type of adjustment processing and its conditions.

Adjustment processing includes image density adjustment 305 and color misregistration adjustment 306. A counter threshold (N) 302 and counter threshold margin (M) 303 are determined in accordance with the type of adjustment processing. The counter threshold (N) 302 indicates the upper limit value of the number of printed sheets in order to determine the timing when adjustment processing is executed. Reference numeral 304 denotes a time taken for each adjustment processing. The controller 30 in FIG. 1B stores the counter threshold (N) 302 and margin (M) 303 in advance.

In FIG. 6, reference numeral 301 denotes an item representing the type of adjustment processing. The counter threshold 302 serves as a condition to determine the timing to execute adjustment processing. For example, density adjustment processing is executed every time the value of a counter incorporated in the CPU 37 to count the cumulative number of prints reaches 300. A counter is provided for each adjustment processing item. The counter for density adjustment processing is cleared to 0 after executing density adjustment processing. When the counter value reaches 300 again, it is determined that density adjustment processing is to be executed at this timing. When the value of the density adjustment processing counter reaches 300, the feeding interval between sheets is controlled to be wider than a normal printing interval. Each image forming station forms toner patch images so as to form an image adjusting pattern in a non-image area between two sheets on the conveyor belt 7 (see the down sequence printing 103 in FIG. 1A). In this manner, each adjustment processing is executed when the value of a corresponding counter reaches a threshold, keeping the image quality at a predetermined level.

In the description of FIG. 6, the cumulative number of prints has been exemplified as a condition to determine execution of adjustment processing. However, any count value is available as long as the image quality can be kept at a predetermined level. For example, execution of adjustment processing can also be determined on the basis of a count value such as a video count for accumulating the number of bitmap image data "1", or the operation or stop time of the image forming apparatus.

The margin (M) 303 represents the margin of the counter threshold serving as a condition to determine the adjustment processing execution timing. In other words, when there is some possibility of performing adjustment processing after the down sequence, the margin (M) 303 is a value for performing adjustment processing in advance during the down sequence even if the counter value has not reached the counter threshold (N) 302 yet. The user can arbitrarily set and change the margin (M) 303. Adjustment processing is executed when a counter value C (=N−M) reaches a value (N−M) calculated by subtracting the margin (M) 303 from the counter threshold (N) 302, and the above-mentioned down sequence has already started. That is, adjustment processing is executed in advance when the interval between sheets is widened because of the down sequence.

If the down sequence has not started yet, adjustment processing is executed when the counter value C reaches the counter threshold (N) 302.

As described above, the image forming apparatus according to the embodiment can control to form an image adjusting pattern and execute image adjustment by utilizing a sheet interval widened during the down sequence. The image forming apparatus can, therefore, ensure both good fixing characteristic and image quality without decreasing the image forming productivity as much as possible. The above-described image adjusting sequence will be described below with reference to FIG. 7.

Figure 4:
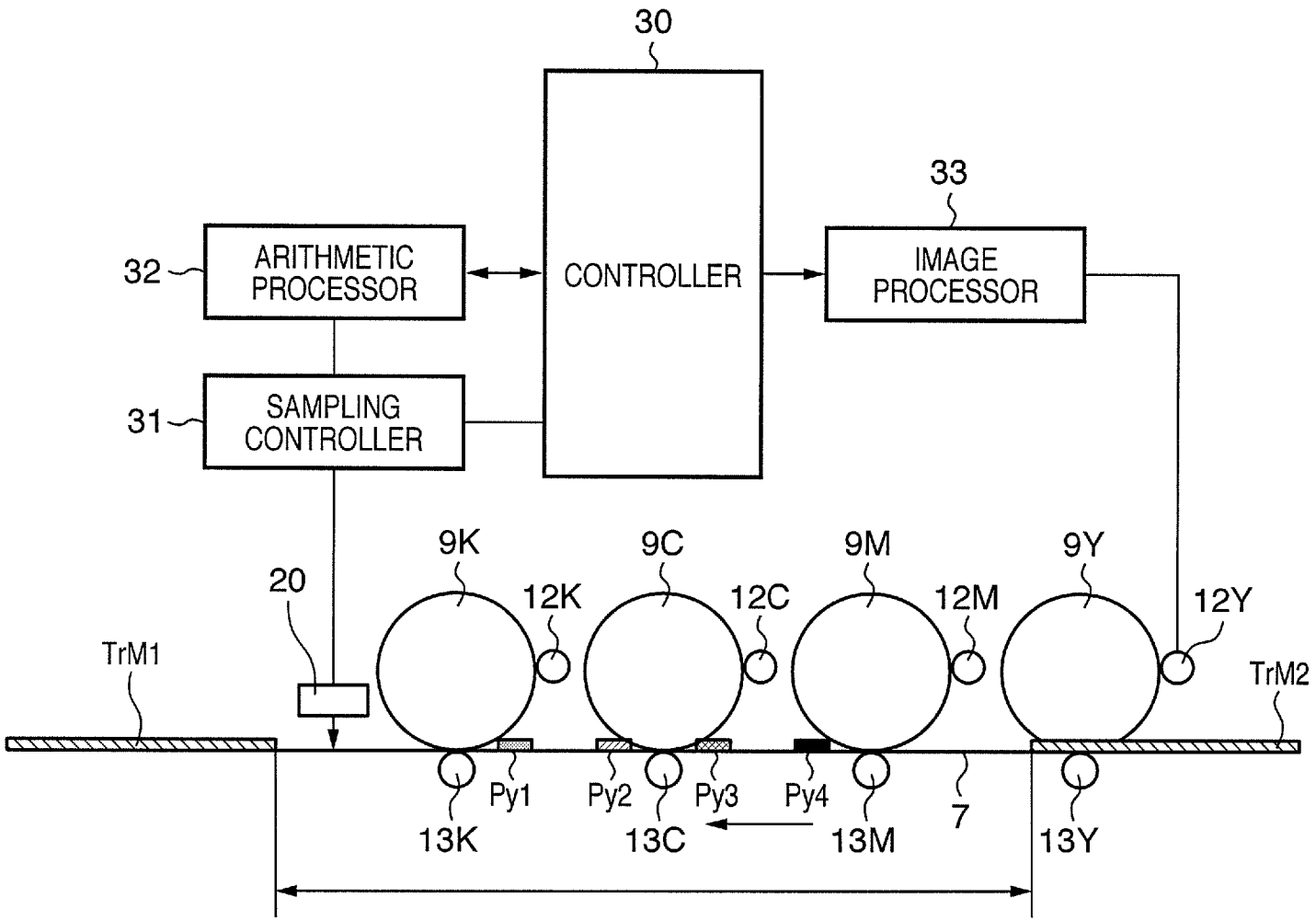
FIG. 4 is a view for explaining the operation of adjustment processing.

(Operation Example in Image Adjustment: FIG. 4)

The following description is related to adjustment processing using a widened sheet interval when the counter value C reaches the value N−M calculated by subtracting the margin (M) 303 from the counter threshold (N) 302, during down sequence.

FIG. 4 shows only the photoconductor 9, developing unit 12, and transfer roller 13 of each image forming station of the image forming apparatus shown in FIG. 1B. The remaining members are not illustrated for convenience. Adjustment processing will be described by exemplifying density adjustment processing performed by forming an image density detection toner patch image in the area (=non-image area) between sheets that is widened because of the down sequence.

In FIG. 4, reference symbol TrM1 denotes a sheet having undergone image formation; and TrM2, a sheet during image formation. Suffixes Y, M, C, and K corresponding to the image forming colors of the image forming stations are added to the photoconductors 9, developing units 12, and transfer rollers 13. Y represents yellow; M, magenta; C, cyan; and K, black. In the following description, assume that the counter value has reached the value N−M calculated by subtracting the margin (M) 303 from the counter threshold (N) 302 in FIG. 6, and the above-mentioned down sequence has already started. After an image is formed on the sheet TrM1, toner patch images at different densities of yellow serving as the first color are formed. In FIG. 4, reference symbols $P_{y1}$, $P_{y2}$, $P_{y3}$, and $P_{y4}$ denote toner patch images formed on the conveyor belt 7.

In the embodiment, the charger 10 uniformly charges the surface of the photoconductor 9 to −700 [V] as a potential VD in the dark. The exposing unit 11 performs scanning exposure with an ON/OFF-controlled laser beam in accordance with patch forming image information, forming latent patch images at −100 [V] as a potential VL in the light. The image processor 33 outputs a developing bias voltage which rises at predetermined steps in correspondence with the latent patch images. The latent patch images on the photoconductor 9 are visualized on the photoconductor 9 as toner patch images at different densities. The DC component voltage value of the developing bias voltage output from the image processor 33 changes.

Figure 5:
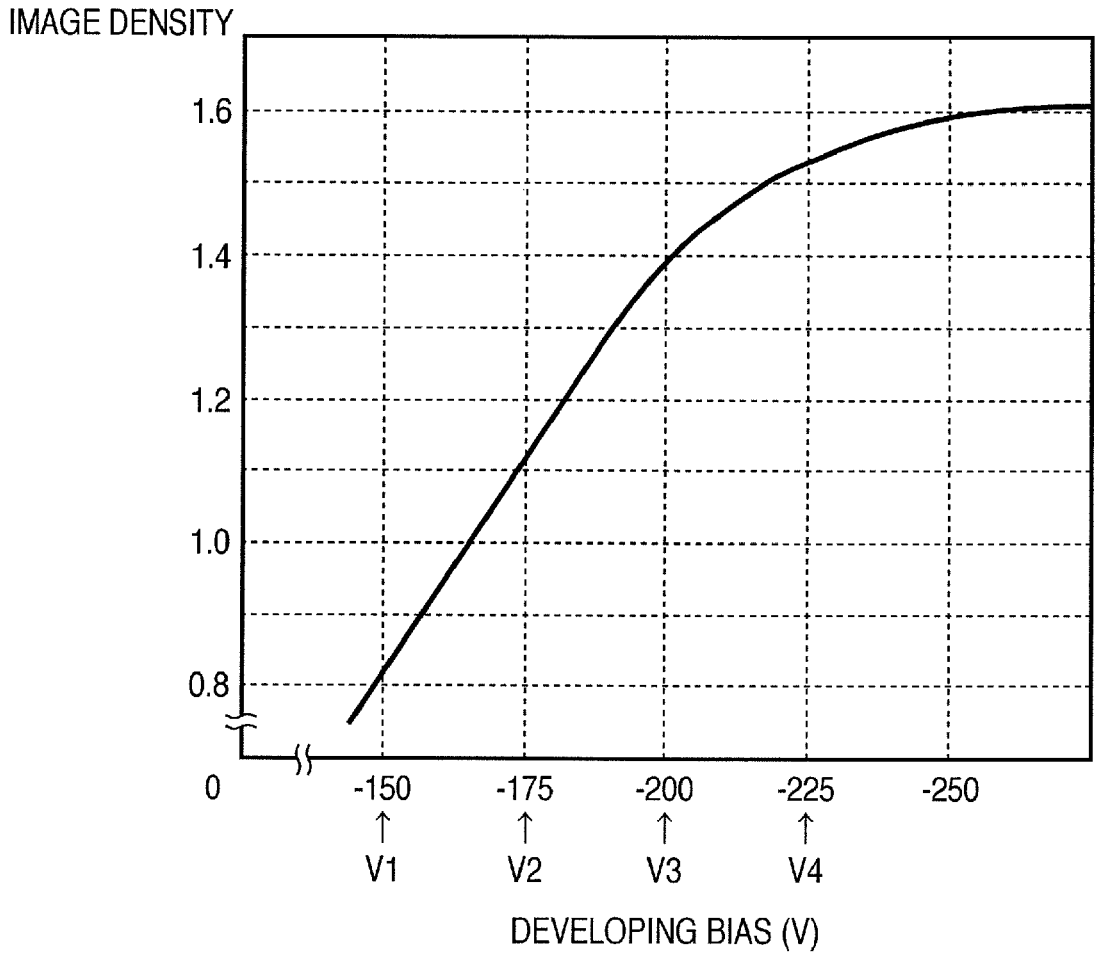
FIG. 5 is a graph for explaining the relationship between the developing bias and the image density.

(Relationship Between Developing Bias and Image Density: FIG. 5)

FIG. 5 is a graph showing the relationship between the image density and the DC component voltage value of the developing bias at the potential VL of −100 V in the light on the photoconductor 9 of the image forming apparatus shown in FIG. 1B.

The embodiment employs V1, V2, V3, and V4 in FIG. 5 as DC component voltage values of the developing bias for developing latent patch images. The DC component voltage values V1, V2, V3, and V4 are −150 V, −175 V, −200 V, and −225 V, respectively, as shown in FIG. 5.

The sampling controller 31 controlled by the controller 30 uses the density sensor 20 to detect the quantities of reflecting light from the toner patch images. Based on the detected reflecting light quantities, the arithmetic processor 32 calculates the densities of the toner patch images $P_{y1}$, $P_{y2}$, $P_{y3}$, and $P_{y4}$.

Based on the density values calculated by the arithmetic processor 32, the controller 30 determines a developing bias value serving as a target density (density of 1.4 shown in FIG. 5 in the embodiment). The controller 30 outputs again the determined developing bias value to the image processor 33. The image processor 33 outputs, to the developing unit 12Y, the developing bias value determined and calculated by the controller 30. That is, the result of measuring the densities of the toner patch images is fed back to the developing unit 12Y. Since an image has already been formed on the sheet TrM2, the feedback result is reflected in image formation on a sheet next to the sheet TrM2.

The toner patches $P_{y1}$, $P_{y2}$, $P_{y3}$, and $P_{y4}$ may also be exposed by changing the density level of the image signal and formed at a developing bias of a fixed value.

As for magenta serving as the second color of the image forming station, cyan serving as the third color, and black serving as the fourth color, toner patch images are formed by the same procedures as those described above. Determined developing bias values can be fed back to the developing units 12M, 12C, and 12K.

In the down sequence in which the sheet feeding interval is widened from the first feeding interval to the second one to decrease the number of printed sheets per unit time, density adjustment processing which toner patch images in yellow serving as the first color are formed in a non-image area between the sheets TrM1 and TrM2 is performed. Density adjustment processing which toner patch images in the second color are formed in a non-image area between the sheet TrM2 and the next sheet is performed. Density adjustment processing which toner patch images in the third and subsequent colors are formed in non-image areas between subsequent sheets is performed.

In the down sequence in which the sheet feeding interval is further widened from the second feeding interval to the third one to further decrease the number of printed sheets per unit time, density adjustment processing which toner which toner patch images in yellow serving as the first color and cyan serving as the second color are formed in a non-image area between the sheets TrM1 and TrM2 is performed. Similarly, density adjustment processing which toner which toner patch images in the third and fourth colors are also formed in a non-image area between the sheet TrM2 and the next sheet is performed.

In this way, the embodiment changes the number of colors of toner patch images formed in a non-image area between sheets in accordance with the sheet feeding interval in the down sequence. The above-described method is merely an example. As another method, the number of toner patch images in the same color may also be increased or decreased.

Figure 7:
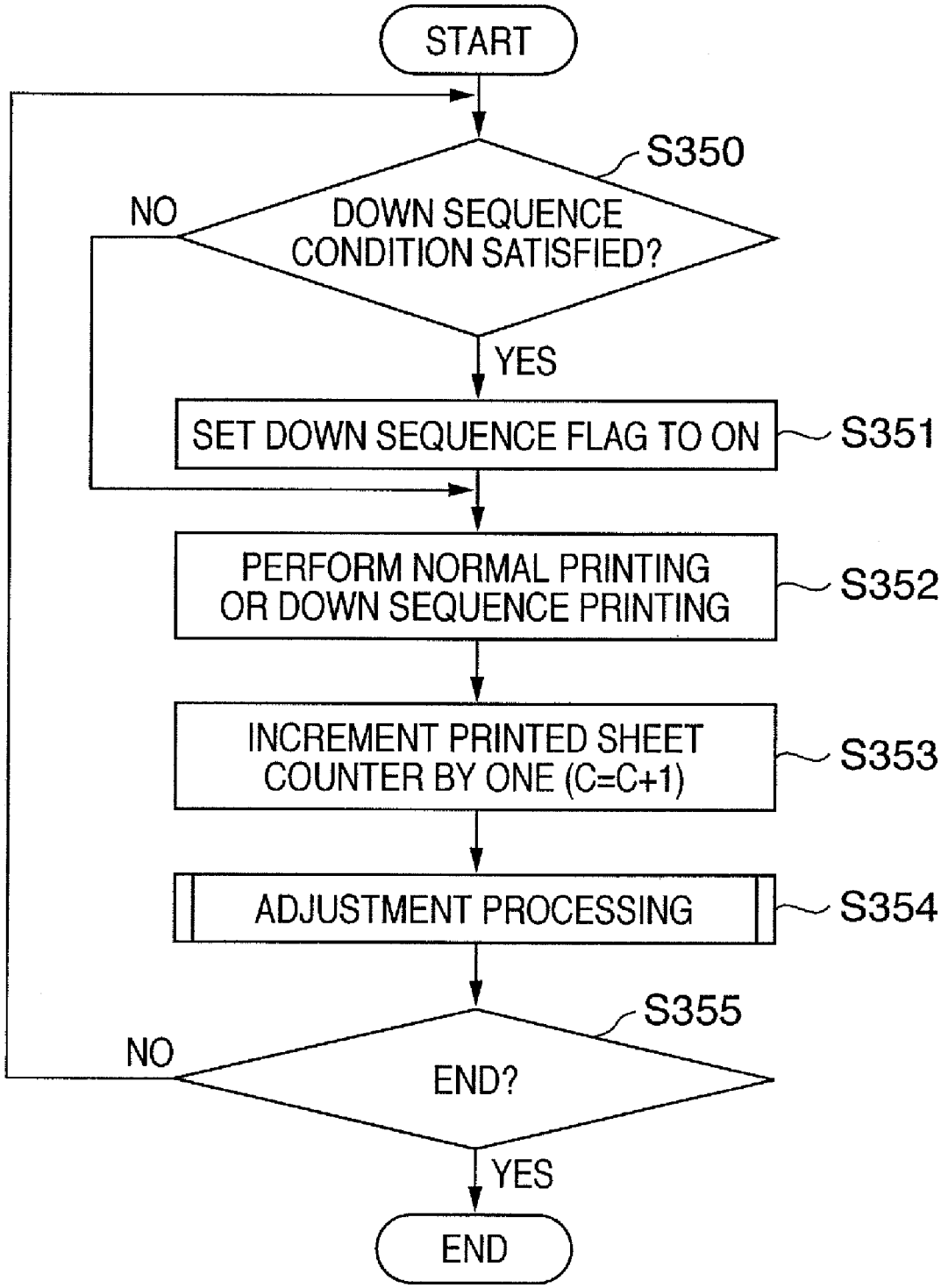
FIG. 7 is a flowchart for explaining an example of image forming processing according to the present invention.
Figure 8:
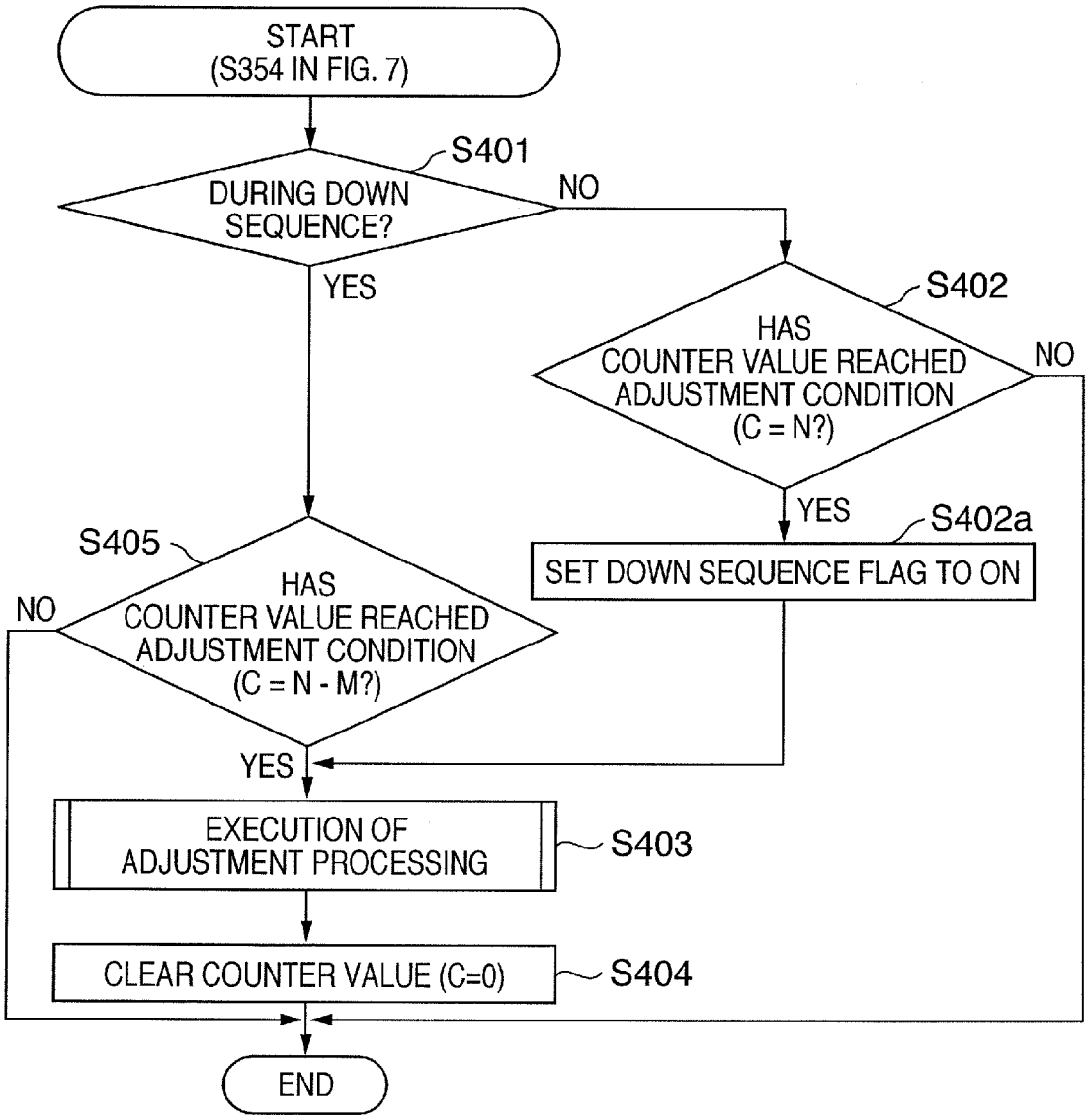
FIG. 8 is a flowchart for explaining details of processing in step S354 of FIG. 7.
Figure 9:
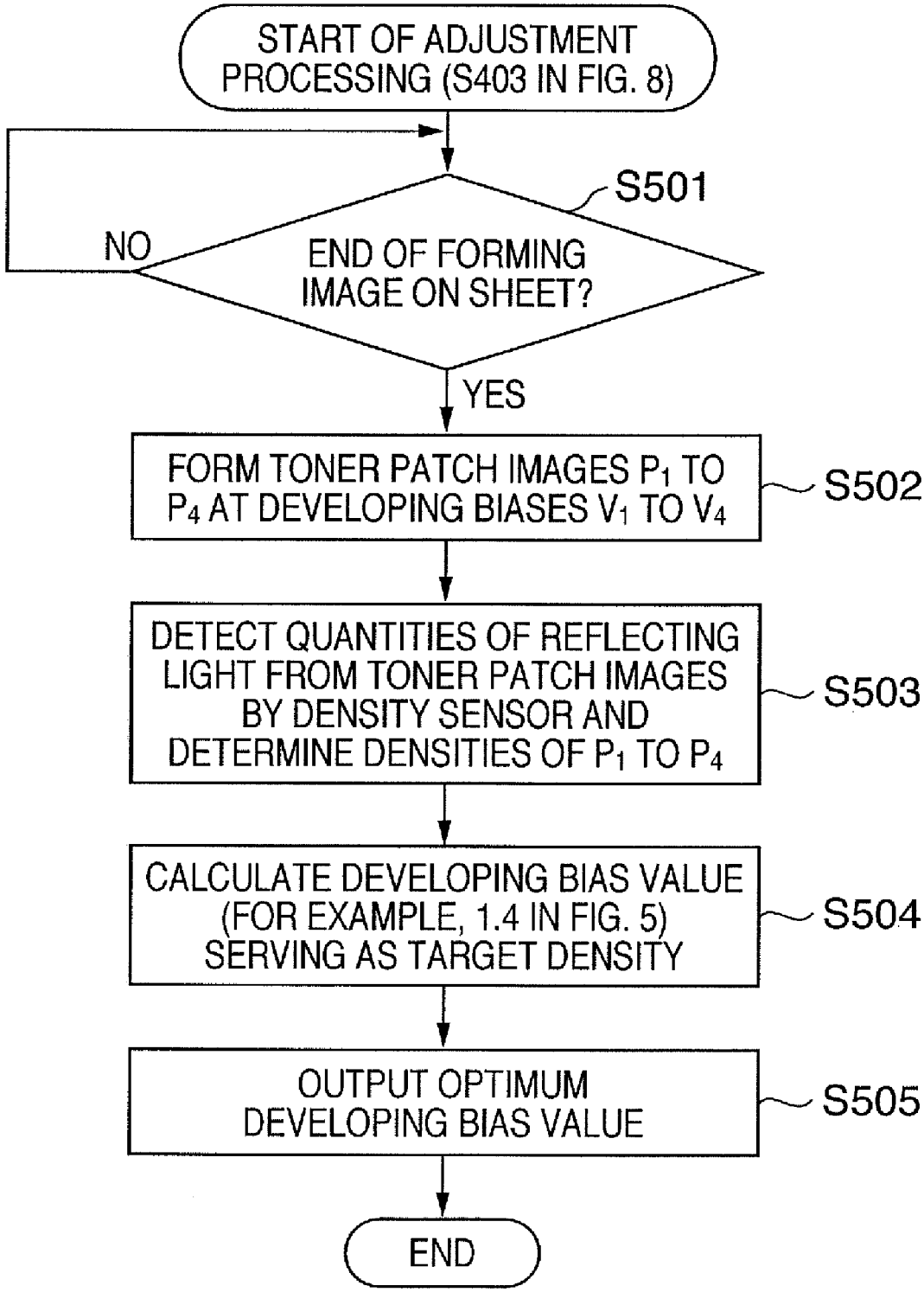
FIG. 9 is a flowchart for explaining details of processing in step S403 of FIG. 8.

(Example of Image Adjusting Control Sequence: FIGS. 7 to 9)

FIG. 7 is a flowchart showing an adjustment processing control sequence in the image forming apparatus. The CPU 37 of the controller 30 shown in FIG. 1B executes the control in FIG. 7 by controlling respective units using the RAM 39 as a work area on the basis of a control program stored in the ROM 38.

In step S350, the CPU 37 checks whether the down sequence condition is satisfied. If the CPU 37 determines that the down sequence condition is satisfied, the process advances to step S351. The CPU 37 sets a down sequence flag in the RAM 39 to ON, and the process advances to step S352. If the CPU 37 determines in step S350 that no down sequence condition is satisfied, the process advances to step S352 without doing anything.

In step S352, if the down sequence flag is OFF, the CPU 37 controls the respective units to form images on a sheet under the normal printing condition (sheet interval $d_1$) (corresponding to the normal printing 101 in FIG. 1A). If the down sequence flag is ON, the CPU 37 controls the respective units to form images under the down sequence printing condition (sheet interval $d_2$) (corresponding to the down sequence printing 102 in FIG. 1A). In step S353, the CPU 37 counts the number of printed sheets.

The process advances to step S354, and the CPU 37 performs adjustment processing. Then, the process advances to step S355, and the CPU 37 determines whether image forming processing is to end. If the image forming processing is to end, a series of work operations ends; if the image forming processing is not to end, the process resumes to step S350. The processing in step S354 will be described in detail with reference to FIG. 8.

FIG. 8 is a flowchart for explaining details of the adjustment processing in S354 of FIG. 7.

In step S401, the CPU 37 determines whether the current printing operation is based on the down sequence. If the CPU 37 determines in step S401 that the current printing operation is based on the down sequence (YES in step S401), the process advances to step S405; if NO, to step S402.

In step S402, the CPU 37 determines whether the adjustment processing counter value (cumulative number of prints) has reached the count threshold N (C=N?) in order to determine the timing when the adjustment processing is executed.

If the counter value C has not reached the count threshold N (C<N) in step S402, the CPU 37 controls to end a series of work operations, end the adjustment processing, and continue the printing operation.

If the adjustment processing is to be executed at this timing (C=N) in step S402, the process advances to step S402*a*. In step S402*a*, the CPU 37 sets the down sequence flag to ON, and ends a series of work operations.

If the CPU 37 determines in step S401 that the current printing operation is based on the down sequence, the CPU 37 determines in step S405 whether the adjustment processing counter value has reached a value calculated by subtracting the margin M from the count threshold N in order to determine the timing when the adjustment processing is executed. If the counter value has reached the value (C=N−M), the CPU 37 executes the adjustment processing in step S403. If the counter value has not reached the value (C<N−M), the CPU 37 ends a series of work operations without doing anything.

FIG. 9 is a flowchart for explaining details of the control sequence of the adjustment processing in step S403 of FIG. 8.

In step S501, the CPU 37 determines whether an image has been formed on a sheet (sheet TrM1 in FIG. 4). If no image has been formed on the sheet, the process waits till the end of image formation. After the end of image formation, the process advances to step S502.

In step S502, the CPU 37 controls to form toner patch images P1, P2, P3, and P4 on the conveyor belt 7 at the developing biases V1, V2, V3, and V4 (e.g., −150 V, −175 V, −200 V, and −225 V in FIG. 5). Examples of P1, P2, P3, and P4 are the yellow patches $P_{y1}$, $P_{y2}$, $P_{y3}$, and $P_{y4}$ in FIG. 4.

In step S503, the CPU 37 controls the sampling controller 31 and arithmetic processor 32 to detect the quantities of reflecting light from the patches by the density sensor 20. Based on the detected reflecting light quantities, the CPU 37 determines the densities of the patches $P_{y1}$, $P_{y2}$, $P_{y3}$, and $P_{y4}$.

In step S504, the CPU 37 controls the arithmetic processor 32 to determine a developing bias value serving as a target density (e.g., a density of 1.4 shown in FIG. 5) from the determined density values.

In step S505, the CPU 37 controls the image processor 33 to output the determined optimum developing bias value. Then, the CPU 37 feeds back, to the developing unit 12Y, the result of measuring the densities of the toner patch images, and forms a subsequent image.

Under the control as shown in FIG. 7, the timing when adjustment processing is executed is determined during the down sequence earlier than during normal printing. Adjustment processing, which is originally executed after the end of the down sequence, is highly likely to be executed during the down sequence. This can minimize a decrease in the number of printed sheets per unit time.

The value of the margin M and the sheet feeding interval in the down sequence suffice to be determined on the basis of the result of, e.g., experimentally obtaining the time taken to restore the temperature of the fixing unit to an original set temperature range after the temperature drops.

Figure 10:
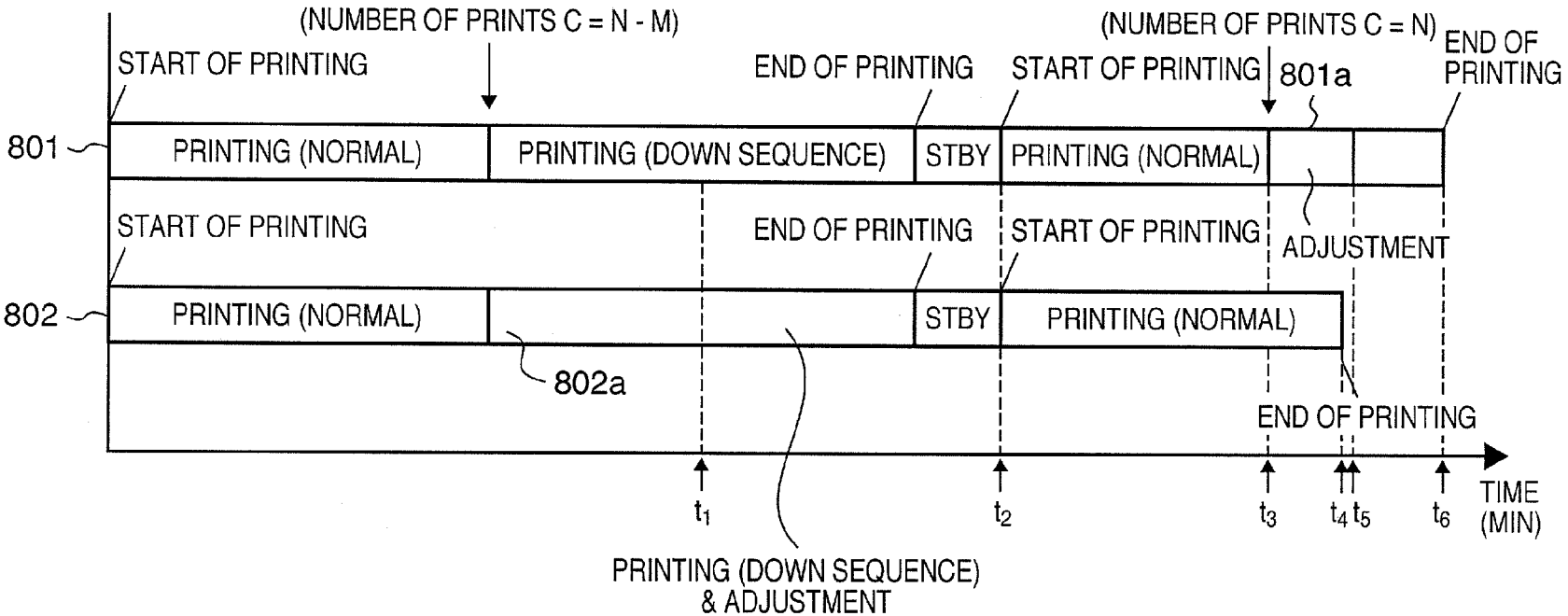
FIG. 10 is a view for explaining an effect obtained by the present invention.

An effect of the embodiment will be explained with reference to FIG. 10.

Reference numeral 801 denotes a conventional image forming sequence. When the counter value reaches the print count N (or video count or time) (time t3), printing is interrupted. After adjustment processing 801*a* is performed, printing resumes at time t5 and ends at time t6 in FIG. 10.

In contrast, according to image forming sequence adjustment processing 802 in the embodiment, when the counter value C reaches N−M during the down sequence (time t1 in FIG. 10), adjustment processing, which is originally executed at C=N (time t3), can be executed in parallel with the down sequence. Since no adjustment processing need be performed at time t3, image forming processing can end at time t4. The end time of image formation, which is time t6 according to the conventional sequence, can be quickened to time t4.

This applies to even formation of toner patch images for position adjustment processing in addition to density adjustment processing, as described above.

In the embodiment, toner patch images for adjustment processing are formed on the conveyor belt to detect their densities. However, the toner patch image detecting method is not limited to this. For example, toner patch images can also be detected on the photoconductor 9. In an image forming apparatus in which an intermediate transfer member exists between the photoconductor 9 and the transfer roller 13, toner patch images on the intermediate transfer member can also be detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-259493 filed Sep. 25, 2006, and No. 2007-228287 filed Sep. 3, 2007, which are hereby incorporated by reference herein in their entirety.

What is claimed is:

1. An image forming apparatus comprising:

a feeding unit adapted to feed a sheet;

an image forming unit adapted to form an image on an image carrier;

a transfer unit adapted to transfer, to the sheet, the image formed on the image carrier;

a fixing unit adapted to fix the transferred image onto the sheet;

a temperature detection unit adapted to detect a temperature of said fixing unit;

a feeding interval changing portion adapted to widen a feeding interval between sheets fed by said feeding unit, when said temperature detection unit detects that the temperature of said fixing unit falls outside a set temperature range;

an adjustment portion adapted to execute adjustment processing to form on the image carrier an adjusting image for adjusting an image forming condition, and adjust the image forming condition on the basis of a result of reading the adjusting image; and a determination portion adapted to determine a timing to execute the adjustment processing by comparing the number of images formed after executing a recent adjustment processing with a reference value, wherein when said temperature detection unit detects that the temperature of said fixing unit falls outside the set temperature range, said determination portion changes the reference value so that a timing to be determined when said temperature detection unit detects that the temperature of said fixing unit falls outside the set temperature range is earlier than a timing to be determined when said temperature detection unit detects that the temperature of said fixing unit does not exceed the set temperature range.

2. The apparatus according to claim 1, wherein when said feeding interval changing portion widens the feeding interval, said adjustment portion forms the adjusting image between an image formed on a sheet and an image formed on the next sheet.

3. The apparatus according to claim 1, wherein said transfer unit has a conveyance medium which carries and conveys the sheet fed by the feeding unit, and said adjustment portion reads the adjusting image transferred from the image carrier to the conveyance medium.

4. The apparatus according to claim 1, wherein said transfer unit has an intermediate transfer member which receives an image formed on the image carrier and transfers the image onto the sheet, and said adjustment portion reads the adjusting image transferred from the image carrier to the intermediate transfer member.

5. The apparatus according to claim 1, further comprising a counter adapted to count the number of printed sheets, wherein when the number of sheets counted by said counter reaches the reference value, said determination portion determines that the current timing is the timing when the adjustment processing is executed.

6. The apparatus according to claim 1, wherein when temperatures at an end of a fixing roller of said fixing unit in an axis direction of the fixing roller exceed a predetermined temperature, said feeding interval changing portion widens the feeding interval.

7. The apparatus according to claim 1, wherein when a temperature at a center of a fixing roller of said fixing unit in an axis direction of the fixing roller becomes lower than a predetermined temperature, said feeding interval changing portion widens the feeding interval.

8. The apparatus according to claim 1, wherein when an image forming time exceeds a threshold, said determination portion determines the timing to execute the adjustment processing.

9. The apparatus according to claim 1, wherein said determination portion sets a reference value for determination when said temperature detection unit detects that the temperature of said fixing unit falls outside the set temperature range, to be smaller than a reference value for determination when said temperature detection unit detects that the temperature of said fixing unit does not exceed the set temperature range.

10. The apparatus according to claim 1, wherein said image forming unit forms images in a plurality of colors, when the temperature of said fixing unit falls outside the set temperature range, said feeding interval changing portion changes the feeding interval to a second feeding interval larger than a preset first feeding interval, or a third feeding interval larger than the second feeding interval, and when the feeding interval is the second feeding interval, said adjustment portion forms adjusting images in a predetermined number of colors between an image formed on a sheet and an image formed on the next sheet, and when the feeding interval is the third feeding interval, forms, between an image formed on a sheet and an image formed on the next sheet, adjusting images in the number of colors larger than the predetermined number of colors.

11. An image adjusting method for an image forming apparatus having a feeding unit adapted to feed a sheet, an image forming unit adapted to form an image on an image carrier, a transfer unit adapted to transfer, to a sheet, the image formed on the image carrier, a fixing unit adapted to fix the transferred image onto the sheet, and a temperature detection unit adapted to detect a temperature of the fixing unit, the method comprising:

a feeding interval changing step of widening feeding interval between sheets fed by said feeding unit, when the temperature detection unit detects that the temperature of the fixing unit falls outside a set temperature range;

an adjustment step of executing adjustment processing to form on the image carrier an adjusting image for adjusting an image forming condition, and adjust the image forming condition on the basis of a result of reading the adjusting image; and a determination step of determining a timing to execute the adjustment processing by comparing the number of images formed after executing a recent adjustment processing with a reference value, wherein when said temperature detecting unit detects that the temperature of said fixing unit falls outside the set temperature range, a reference value is changed in the determination step so that a timing to be determined when said temperature detection unit detects that the temperature of said fixing unit falls outside the set temperature range is earlier that a timing to be determined when said temperature detection unit detects that the temperature of the fixing unit does not exceed the set temperature range.

* * * * *